United States Patent [19]

Nidelkoff

[11] 4,164,824

[45] Aug. 21, 1979

[54] CHANGEABLE CHARACTER SIGN STRUCTURE

[75] Inventor: James G. Nidelkoff, White Bear Lake, Minn.

[73] Assignee: Minnesota Mining and Manufacturing Company, St. Paul, Minn.

[21] Appl. No.: 924,624

[22] Filed: Jul. 14, 1978

Related U.S. Application Data

[62] Division of Ser. No. 756,258, Jan. 3, 1977, Pat. No. 4,115,936.

[51] Int. Cl.[2] ..... G09F 9/32

[52] U.S. Cl. ..... 40/450; 40/488

[58] Field of Search ..... 40/492, 493, 449, 450, 40/452, 488

[56] References Cited

U.S. PATENT DOCUMENTS

| | | | |
|---|---|---|---|
| 1,357,457 | 11/1920 | Jorgensen | 40/450 |
| 1,755,315 | 4/1930 | Chubb | 40/452 |
| 3,096,594 | 7/1963 | Skrobisch | 40/449 |
| 3,362,093 | 1/1968 | Joselevich | 40/452 |
| 3,792,540 | 2/1974 | Watanabe et al. | 40/449 |
| 4,024,532 | 5/1977 | Sherwin | 40/450 |
| 4,063,377 | 12/1977 | Hukill | 40/492 |

*Primary Examiner*—Louis G. Mancene
*Assistant Examiner*—Wenceslao J. Contreras
*Attorney, Agent, or Firm*—Cruzan Alexander; Donald M. Sell; Robert W. Burns

[57] ABSTRACT

Sign having self-storing characters which are quickly changeable. The face of the sign has a patterned array of openings juxtaposed against a contrasting background. The background may be supplied by color contrast and/or by illumination.

5 Claims, 5 Drawing Figures

CHANGEABLE CHARACTER SIGN STRUCTURE

This is a division of applicatiion Ser. No. 756,258, filed Jan. 3, 1977, now U.S. Pat. No. 4,115,936.

BACKGROUND OF THE INVENTION

1. Field of the Invention

This invention relates to sign structures having changeable characters and, more particularly, to an improved sign structure having self-storing characters which may be quickly changed.

2. Description of the Prior Art

Signs having mechanically changeable characters are well known. Typically, such signs utilize discrete removable numbers and letters which are temporarily mounted to a sign face. The letters and numbers can be mounted on tracks or otherwise secured to the sign face. Applications include theater marquees, gasoline price signs, and billboards.

One disadvantage of the prior art signs is that the characters must be replaced to change the display. For track-mounted characters, this can involve removing the outermost characters to permit sliding the inner characters off the track. Also, for elevated signs, changing the display can be a time-consuming and hazardous undertaking.

It is highly desirable to have a sign of economical construction, which utilizes self-storing, quickly changeable characters, is vandal resistant, and is easily adaptable for internal illumination, or back lighting.

SUMMARY OF THE INVENTION

The present invention provides a sign structure having quickly changeable, self-storing characters. The face of the sign structure is of a predetermined color and has a patterned array of openings. Shutters are mounted on the sign face, one to an opening, for sliding movement between first and second positions such that, with a shutter in the first or second position, the associated opening is filled with color which is, respectively, the predetermined color or a contrasting color. Means is provided for securing the shutters in the first and second positions.

BRIEF DESCRIPTION OF THE DRAWING

The drawing will be more fully described in reference to the accompanying drawing wherein:

FIG. 6 is a sectional view of the rotatable shutter of FIG. 5, taken along the lines 6—6; and FIG. 7 is a schematic representation of an eleven-segment shutter array for forming alphabetic and numeric characters.

DETAILED DESCRIPTION OF THE PREFERRED EMBODIMENT

Figure 1:
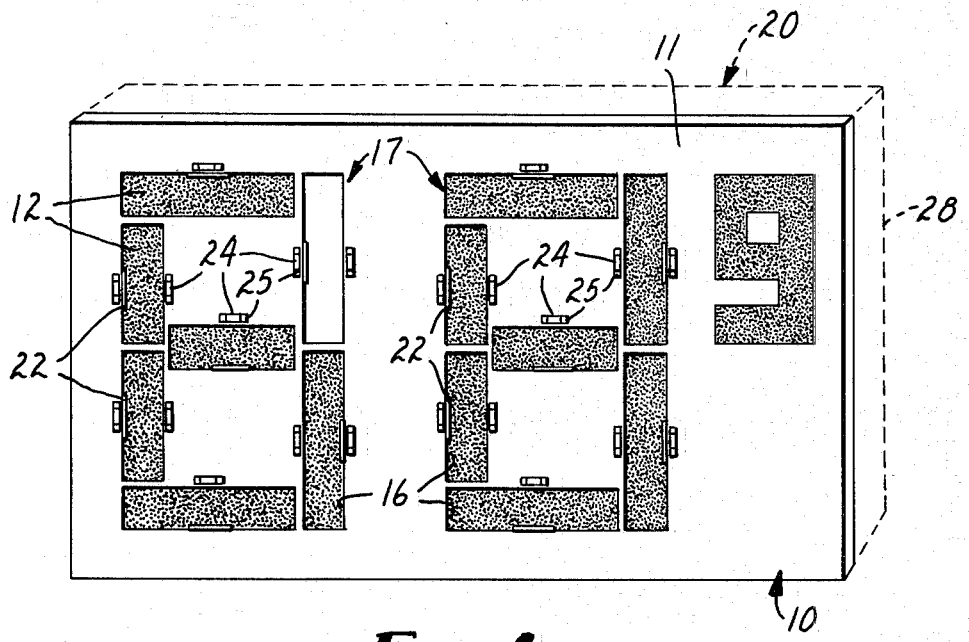
FIG. 1 is a perspective view of a sign, constructed according to the present invention, having quickly changeable, readily readable characters.
Figure 2:
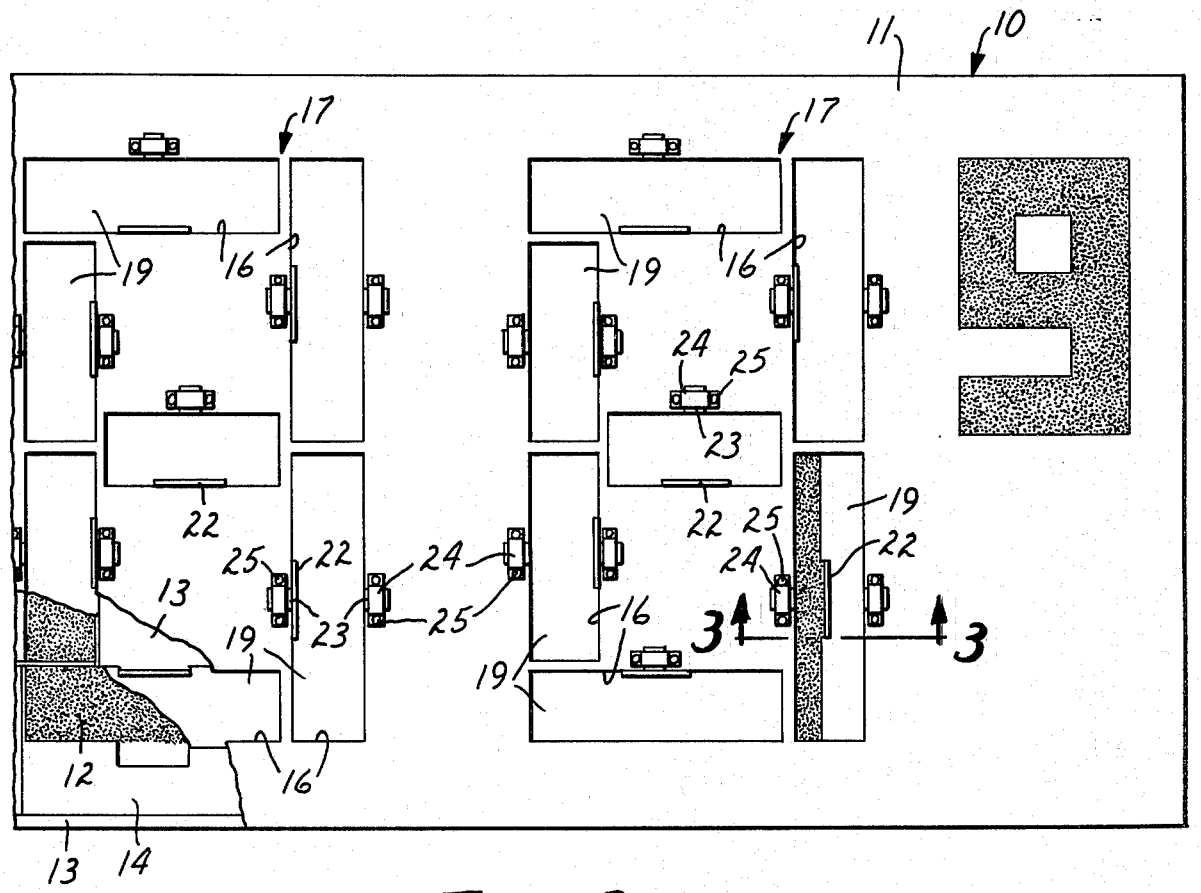
FIG. 2 is a front elevational view of a sign face constructed according to the invention with a portion broken away to show details of the sliding shutter construction.

The present invention provides a sign structure having characters which may be quickly changed. The characters are self-storing in that changes do not require physical attachment or removal of the characters. Referring to FIG. 2, there is illustrated a sign face structure 10 constructed according to the present invention. The sign face structure 10 may itself be used as a sign or may be affixed to or incorporated into other sign structures. For example, as shown in FIG. 1, the structure 10 comprises the face of an enclosed sign 20 which is used for advertising gasoline prices.

Referring again to FIG. 2, in one embodiment the sign face structure 10 comprises an apertured front plate 11, a visually contrasting back plate 12, and intermediate plates 13 and 14. These components may be held together by rivets, adhesive or other means.

Front plate 11 of the sign face 10 has a plurality of apertures or openings 16—16 that are the basis of the information conveyed by the sign face. The openings 16—16 are rectangular and form the segments of seven-segment matrices 17—17, each of which is capable of forming the numbers 0 to 9.

Figure 3:
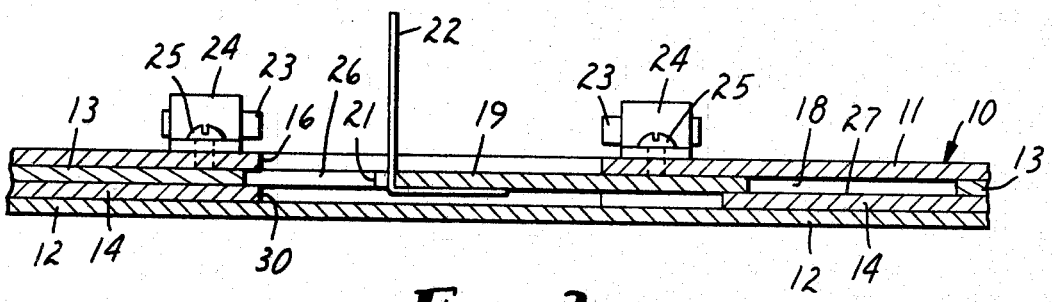
FIG. 3 is a sectional view of a portion of the sign face structure of FIG. 2, taken along lines 3—3.

Referring to FIGS. 2 and 3, each intermediate plate 13 has an opening 18 which defines a track for a shutter plate 19. The shutters 19—19 are retained for sliding movement along their associated tracks 18—18 by the front plate 11 and intermediate plate 14. The length of each track opening 18 in the direction of sliding movement (left to right and vice versa in FIG. 3) is approximately twice the corresponding dimension of the associated segment opening 16. Each track 18 may be considered to comprise two portions relative to the associated segment opening 16; a first, toward portion 26 (FIG. 3) which is below and aligned with the segment opening 16; and a second, rear portion 27 (FIG. 3) which is offset from the segment opening.

Each shutter 19 is of sufficient size to span or close its associated segment opening 16. Thus, the shutter 19 may be moved along the track opening 18 between a first, forward position (corresponding to forward portion 26 of the track) closing the segment opening 16 and a second, retracted position (corresponding to rear portion 27 of the track). In the retracted or open position, substantially all of the shutter 19 except a leading edge 21 (FIG. 3) is removed from the segment opening 16, thereby revealing the visually contrasting back plate 12.

A flange or handle 22 is attached to (or formed integrally with) the leading edge 21 of each shutter to permit manual opening and closing of the shutter. As shown in FIG. 3, the handle 22 is L-shaped and affixed to the lower side of its shutter 19. A slot 30 is formed in the plate 14 to permit passage of the handle 22 during movement of the shutter 19. Preferably, the handle 22 is also utilized as part of a latching device for holding the shutter in the closed and/or the open position. In a preferred embodiment, the handle 22 is formed of magnetic material or a magnet is affixed to the handle. The latching device is completed by magnet(s) 23—23, each of which is mounted to the sign face 10 by a bracket 24 which is attached to the front plate 11 by screws 25—25. The magnets 23—23 are used to maintain the handle in positions corresponding to the open and closed positions of the shutter.

The shutters 19—19 associated with the vertically-oriented ones of the segments 16—16 forming the sides of each number matrix 17 are designed to move in horizontal directions. As shown most clearly in FIGS. 3 and 3, magnets 23—23 are utilized on opposite sides of the vertically-oriented segments (at the ends of the horizontal path of travel of the handle 22) to retain the shutters in the open and closed positions. Typically, those shutters used with the horizontally-oriented segments of each number matrix 17 have a vertical path of movement. These horizontally-oriented shutters are retained in the lower positions (typically, the closed position) by gravity and thus require magnets on only the upper side of the segment.

The shutters 19—19 may be selectively opened and closed to define any number from 0 to 9. Any number of matrices 17—17 may be used, with or without other indicia, in accordance with the type of information to be displayed. For example, the exemplary sign face structure 10 shown in FIG. 1 is constructed in accordance with the convention used for most service station gas price signs. The structure 10 has at least two number matrices 17—17 and has the fixed number "9" for indicating the cost per gallon of gasoline. The price displayed in FIG. 1 is 68.9¢. The sign display is easily changed as the price of gasoline changes. Of course, other combinations of numbers and combinations of numbers with other, fixed characters will be readily devised by those skilled in the art.

As mentioned previously, at least the portions of the front surface of the back plate 12 that are aligned with the segment openings 16—16 are of a color that contrasts with the color of the face of the front plate 11 and the front face of the shutters 19—19. This enhances the visibility of the sign face information display. To illustrate, the back plate may be white or orange, while the shutters and front plate are a dark gray or black. Alternatively, the front plate 11 and back plate 12 may be of the same or similar color and the characters may be supplied by the color contrast of the shutters. Also, the sign face structure 10 may be illuminated or backlighted. As an example, in the sign structure 20 of FIG. 1, the sign face 10 encloses a sign box 28 which may contain lights for illuminating the segment openings 16—16 via a translucent or transparent back plate 12.

Figure 4:
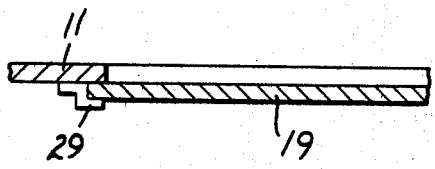
FIG. 4 is a sectional view of a portion of the sign of FIG. 1, taken along lines 4—4 of FIG. 1, showing an alternative arrangement for slidably mounting the shutters.
Figure 5:
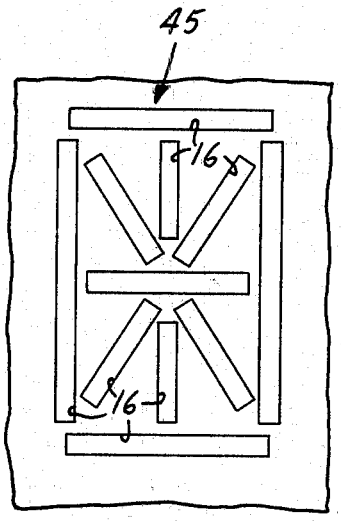
FIG. 5 is a perspective view of an alternative embodiment of the invention, a rotatable shutter embodiment.

An alternative arrangement for slidably mounting the shutters 19—19 is shown in FIG. 4. Here, each shutter is supported at its opposite sides by brackets 29—29 (only one side and one bracket 29 are shown in FIG. 4), which mount the shutter for sliding movement perpendicular to the plane of the drawing. For the matrices 17—17 of rectangular openings 16—16 illustrated in FIG. 1, the brackets 29—29 are mounted at the short sides of the openings 16—16 to permit reciprocating movement of the shutters 19—19 in a direction parallel to the short side and perpendicular to the length of the openings and shutters. It will be noted that the use of the brackets 29—29 eliminates the need for intermediate plates 13 and 14 (shown in FIG. 3). Of course, with the elimination of the intermediate plates 13 and 14, it is desirable to use means, such as spacers (not shown), to provide adequate separation for movement of the shutters 19—19 between the front plate 11 and the back plate 12.

The sign face structure 10 provides several features that are desirable in a price or information changer. As explained, the characters and, thus, the information displayed can be quickly changed. The characters are self-storing in that they can be changed by rearrangement of elements contained within the sign face, rather than by attachment and removal of characters. The sign face structure is simple and is relatively inexpensive to construct. It leads itself to sturdy, vandal resistant construction. As described previously, the sign face structure can be incorporated into an internally lighted or backlighted sign structure. When incorporated in an elevated sign, a pole can be used to change the characters from the ground. Also, the Wagner "mechanical hand" is available for changeable copy boards up to 18 feet in height. The Wagner mechanical hand is available from 3M National Advertising Company, 6850 S. Harlen Ave., Bedford Park, Argo, Ill. 60501.

The sign face structure 10 is also adaptable to characters other than numbers. The matrices 17—17 can of course be used to form alphabetic characters. More distinct alphabetic characters, as well as numberic characters, are provided by an eleven-segment matrix 45 shown in FIG. 7. The invention is not limited to numeric and alphabetic characters, however, for knowledge of the present invention will enable those skilled in the art to devise other symobls as well. Those skilled in the art will also devise constructions other than those illustrated. For example, the handle 22 (FIG. 3) may be formed integrally with the shutter 19, thus eliminating the need for slot 30 and plate 14. Also, in some applications, friction between the track or brackets and the shutters may be used to retain the shutters in the open and closed positions and thereby obviate the need for magnets.

Having thus described the preferred and alternative embodiments of the sign face structure of the present invention, what is claimed is:

1. A sign face structure having changeable characters, comprising:

a plate having front and rear surfaces and having a patterned array of rectangular openings;

shutter plates being adapted for sliding movement between a forward position closing said plate openings and a retracted position substantially out of said plate openings:

bracket means affixed to the rear surface of said plate for slidably mounting said shutter plates; and latch means for securing said shutter plates in the forward or retracted position, said latch means comprising a magnetizable flange extending transversely from said shutter plate; and a magnet positioned proximate the position of said flange corresponding to a position selected from the forward position or the retracted position of said shutter plate for retaining said shutter plate in that position.

2. A sign face structure having changeable characters, comprising:

a first, front plate having a patterned array of rectangular openings;

a second, back plate having a front surface, at least the portions of the front surface corresponding to said front plate openings being visually contrasting relative to said front plate;

a third plate between said front and back plates and having openings therein, a first portion of a third plate opening being aligned with a front plate opening and a second portion being offset from the front plate opening;

shutter plates positioned within said third plate openings and retained between said front and back plates for slideable movement between a forward position closing said front plate openings and a retracted position substantially out of said front plate openings, and latch means for securing each said shutter plates in the forward or retracted position.

3. The sign face structure of claim 2 wherein said latch means comprises:

a magnetizable flange extending from one side of said shutter plate; and a magnet positioned proximate the position of said flange corresponding to the forward position or the retracted position of said shutter plate for retaining said shutter plate in that position.

4. The sign structure of claim 2 or 3 wherein at least the portions of the back plate corresponding to the front plate openings afford said contrasting appearance by said back plate being one of translucent and transparent material.

5. A sign structure having changeable characters, comprising:

a sign face of a predetermined color and having a patterned array of openings;

shutters mounted to said sign face, one to an opening, each of said shutters having a plate mounted for sliding movement between a first and second position, at least a first surface portion of each shutter being of a predetermined color which is the same as, or contrasts with, the sign face color, and each shutter being movable between said first position for displaying said first surface portion in said opening and said second position wherein said first surface portion is not visible at said opening; and latch means for securing said shutters in said first or second position.

* * * * *